US006634131B1

(12) United States Patent
Fitzpatrick

(10) Patent No.: US 6,634,131 B1
(45) **Date of Patent: *Oct. 21, 2003**

(54) MAGAZINE EXTRACTION GRIPS

(76) Inventor: Richard Mark Fitzpatrick, 1109 Par Rd., Broomfield, CO (US) 80020

( * ) Notice: Subject to any disclaimer, the term of this patent is extended or adjusted under 35 U.S.C. 154(b) by 0 days.

This patent is subject to a terminal disclaimer.

(21) Appl. No.: 09/493,433

(22) Filed: Jan. 29, 2000

Related U.S. Application Data

(63) Continuation-in-part of application No. 09/293,403, filed on Apr. 16, 1999, now Pat. No. 6,212,815.

(51) Int. Cl.[7] ..... F41A 15/00
(52) U.S. Cl. ..... 42/90; 42/106; 224/196
(58) Field of Search ..... 42/90, 70.01, 70.02, 42/106, 87, 88, 50, 18, 85; 224/196, 199, 223

(56) References Cited

U.S. PATENT DOCUMENTS

| | | | | | |
|---|---|---|---|---|---|
| D33,384 | S | | 10/1900 | Thorn | |
| 1,245,499 | A | | 11/1917 | Orme | |
| 1,596,076 | A | | 8/1926 | Clancy | |
| 1,756,677 | A | * | 4/1930 | Cook | 224/245 |
| 1,797,951 | A | * | 3/1931 | Gaidos | 224/238 |
| 2,205,967 | A | | 6/1940 | Wise | |
| 2,825,991 | A | | 3/1958 | Stadelmann | |
| 3,000,527 | A | | 9/1961 | Jennings et al. | |
| 3,938,717 | A | * | 2/1976 | Theodore | 224/183 |
| 4,100,694 | A | * | 7/1978 | Musgrave | 42/90 |
| 4,115,943 | A | * | 9/1978 | Musgrave | 42/90 |
| 4,442,962 | A | | 4/1984 | Musgrave | |
| 4,484,404 | A | * | 11/1984 | Johnson | 42/90 |
| 4,528,765 | A | * | 7/1985 | Johnson | 42/70.11 |
| 4,597,213 | A | * | 7/1986 | Musgrave | 42/90 |
| 4,796,937 | A | | 1/1989 | Andrea | |
| 5,303,860 | A | * | 4/1994 | Serafini, Jr. | 42/50 |
| 5,402,594 | A | * | 4/1995 | Switzer | 42/90 |
| 5,484,093 | A | * | 1/1996 | Hellweg et al. | 224/253 |
| 6,050,464 | A | * | 4/2000 | Ramsey, Sr. et al. | 206/3 |

* cited by examiner

*Primary Examiner*—Peter M. Poon
*Assistant Examiner*—Son T. Nguyen
(74) *Attorney, Agent, or Firm*—Geoffrey E. Dobbin

(57) ABSTRACT

A magazine grip attachment for ammunition magazines to aid in extraction of a magazine from ammunition pouches comprising a sleeve of resilient material molded in the general shape of a magazine yet with a smaller inner circumference than the circumference of a magazine so as to require the band to stretch over the magazine. The top of the band has an even slightly smaller inner circumference than the lower part of the band. Extending from the top of the band is a handle designed to allow a finger to wrap around the handle and extract the magazine. Also provided are recessed areas and four diagonal force distribution beams to constrict the invention and allow it to grip a magazine more snugly when the handle is pulled. The invention is also used in combination with a magazine pouch to deaden noise by biasing the magazines against the pouch and each other.

59 Claims, 3 Drawing Sheets

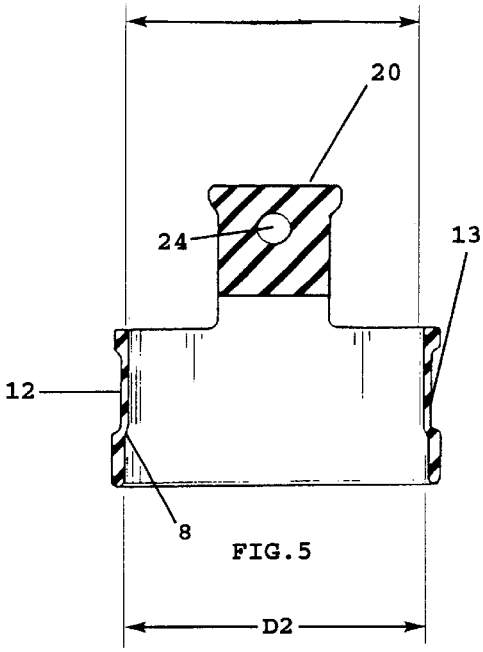
FIG.5
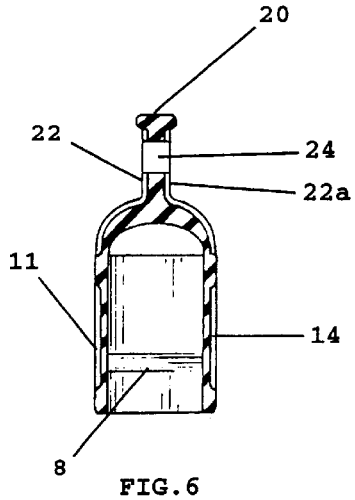
FIG.6
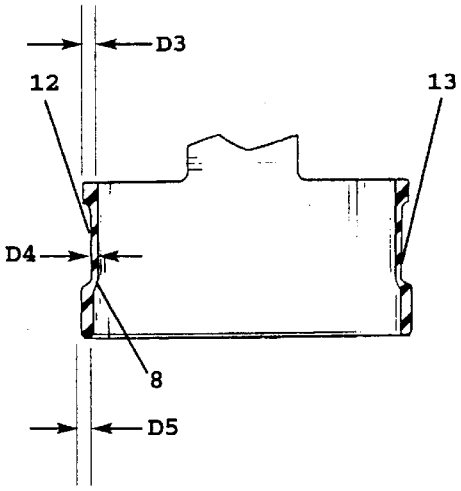
FIG.7A
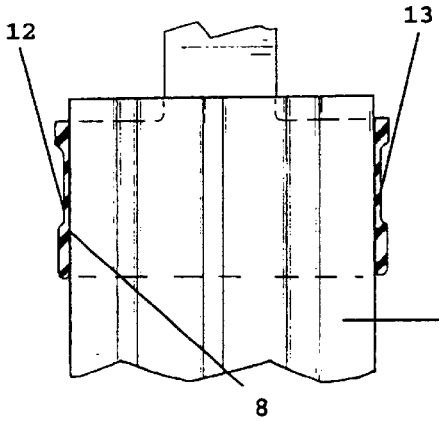
FIG.7B
FIG.7C
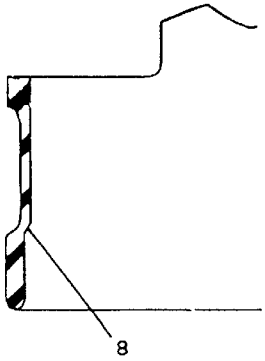
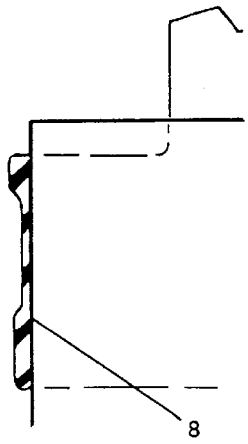
FIG.7D

MAGAZINE EXTRACTION GRIPS

CROSS-REFERENCES TO RELATED APPLICATIONS AND PATENTS

The present application is a continuing-in-part application of prior application Ser. No. 09/293,403 filed Apr. 16, 1999, now U.S. Pat. No. 6,212,815.

FIELD OF INVENTION

The present invention relates to an attachment for ammunition magazines and more particularly to a magazine grip attachment with a pull-tab handle that may be positioned on the butt end of ammunition magazines in order to aid in both extraction from ammunition pouches and insertion into a weapon.

BACKGROUND OF THE INVENTION

The use of detachable loops to aid in the removal of ammunition magazines from a storage compartment is known in the prior art. Likewise, the use of handle attachments or tabs or other extensions to carry ammunition magazines and other objects is also known. These attachments and modifications, while suitable for their individual purposes, are not as suitable for the purpose of this invention, namely extraction of ammunition magazines from ammunition pouches worn on the user. For example, the current practice of forming duct tape loops and tab on ammunition magazines, U.S. Pat. No. 4,796,937 to Andrea; U.S. Pat. No. 4,442,962 to Musgrave; U.S. Pat. No. 3,000,527 to Jennings, et al.; U.S. Pat. No. 2,825,991 to Stadelmann; U.S. Pat. No. 2,205,967 to Wise; U.S. Pat. No. 1,797,951 to Gaidos; U.S. Pat. No. 1,596,076 to Clancy; U.S. Pat. No. 1,245,499 to Orme; and U.S. Pat. No. D-33,384 to Thorn are all illustrative of the prior art.

CURRENT PRACTICE

FORMING DUCT TAPE TABS AND LOOPS

NO PATENT NUMBER

Currently, in the field, soldiers use either loops of parachute cord attached to ammunition magazines by duct tape or they form tabs by folding duct tape over the butt end of their ammunition magazines. With either modification, the loops or tabs aid soldiers in the extraction of said magazines from ammunition pouches carried on the user. However, the duct tape tends to wear and often needs replaced. The duct tape also leaves a sticky residue when it is removed and provides no benefit other than the increased friction or fastening a pull tab or loop to the ammunition magazine.

ANDREA, DOUGLAS J.

INSULATING SHELL AND POURING AID FOR CONTAINER AND METHOD FOR MAKING THE SAME

U.S. Pat. No. 4,796,937

An insulating shell and carrier for a bottle in which the shell is formed of an insulating material. The shell has a main body section, with an opening into which the bottle fits, and an integral handle. The handle is a loop that the user may grasp to hold the bottle while pouring the contents or may otherwise use to carry the bottle. The shell is preferably made out of a flat sheet of material, cut to the desired shape and size and joined at the edges to form a configuration matching the bottle.

MUSGRAVE, DANIEL D.

MAGAZINE HANGER

U.S. Pat. No. 4,442,962

A cartridge magazine hanger adapted for quick removal of a magazine therefrom using only one hand. The magazine is supported by engagement of at least one of its feed lips with a support on the hanger. The hanger is equipped with loops that may be used to attach the hanger to any structure, vehicle, a person's clothing or even a weapon. The hanger also covers the feed mouth of the magazine to protect the ammunition from damage and prevent the entry of extraneous matter into the magazine.

JENNINGS, W.C, ET AL.

HANDLE FOR CONTAINERS

U.S. Pat. No. 3,000,527

This invention is a handle for containers, particularly glass milk containers. The handle is made of an elastomeric material comprising a band and finger grip potions. When warmed, the band portion slips over the rim of a glass milk container. When cooled, the band portion of the handle is not elastic enough to allow the container rim to slip out, thus allowing the user to carry the container using the finger grip portion of the handle.

STADELMANN, RUDOLF

MAGAZINE ARRANGEMENT FOR MEDIUM CALIBRE GUNS

U.S. Pat. No. 2,825,991

This arrangement is for medium caliber guns (20–40 mm caliber). The arrangement is essentially a box with one side open to allow for loading ammunition into the magazine. The top of this arrangement features a detachable metal loop to allow the user to extract the magazines from an ammunition chest.

WISE, CHARLES REX

RIFLE MAGAZINE

U.S. Pat. No. 2,205,967

Magazine designed to increase capacity of a rifle and relating the ammunition in a manner that automatically feeds ammunition through the rifle. A loop is provided on the butt and of the magazine so that it may be attached to the user's clothing or other device.

GAIDOS, ALONZO F.

FIREARMS MAGAZINE

U.S. Pat. No. 1,797,951

Magazine designed to expedite reloading when the magazine is empty. To this end, the magazine uses a retractable sliding plate to allow access to the interior of the magazine and to depress the follower plate, allowing ammunition to be loaded into the magazine. Attached to the sliding plate is a metal finger loop, allowing the user to pull the sliding and follower plates down.

CLANCY, KENNETH A.

BOTTLE CARRIER

U.S. Pat. No. 1,596,076

This bottle carrier is a single elongated strip of flexible material designed to accommodate assorted sizes of bottles. The strip accomplishes its purpose by means of two longitudinally extending slits cut in the strip. Using these slits, the strip may be looped around the neck of the bottle, under the rim. The free ends are then threaded through the slits and brought together to form a carrying loop.

ORME, GARDNER P.

FIREARM MAGAZINE

U.S. Pat. No. 1,245,499

This magazine is designed to aid in the compression of the follower spring and thus, aid in reloading the magazine. The invention is a magazine with its side designed to accommodate the insertion of a pin, which may be used to compress the follower spring by simply squeezing the user's fingers, which are placed over the pin, towards the user's thumb, placed on the underside of the magazine. A loop, which is not integral to the invention, is nonetheless displayed in the drawings of this invention on the butt end of the magazine. Due to its size relative to the magazine, it can be presumed to be used for standard attachment purposes.

THORN, OLIVER

GUN-CARRYING ATTACHMENT FOR CYCLES

U.S. Pat. No. D-33,384

This simple design comprises of two bands of material. One forms an ellipse and the other forms a carrying loop with its ends attached to the elongated sides of the ellipse. The gun is presumably held in place by a small curved member placed on the ellipse.

While the aforementioned inventions accomplish their individual objectives, they do not describe an attachment that is used primarily for the extraction of ammunition magazines from ammunition pouches, as evidenced by the duct tape modifications used in the field. Handle and loop attachments used in the prior art are mainly used for affixing an ammunition magazine to other objects, such as clothing or vehicles, or to carry bottles. In the case where handle attachments are used for extraction, the handle is a simple metal wire forming a loop and is not adapted for use in the various positions a user may wear an ammunition pouch. There are also disadvantages with the duct tape modifications, particularly regarding removal and in the amount of slack in a loop of parachute cord. In this respect, the magazine extraction grip according to the present invention departs substantially from the usual designs in the prior art. In doing so, this invention provides an attachment that is primarily designed for the purpose of aiding the extraction of ammunition magazines from pouches worn on the user.

SUMMARY OF THE INVENTION

In view of the foregoing disadvantages inherent in the known types of handle attachments, this invention provides an improved attachment, a magazine extraction grip. As such, the present invention's general purpose is to provide a new and improved attachment that will aid in the extraction of ammunition magazines from pouches worn on the user.

To attain this, the attachment essentially comprises a sleeve of resilient material, typically molded to fit over the butt end of an ammunition magazine, but alternatives, such as an elastic, knitted fabric, would also work. Extending from the center of the elongated sides of the sleeve is a handle. Ideally, this handle portion is molded of the same material as the sleeve and of one piece with the sleeve. This handle may be any shape, though loops and tabs would be preferred since they are the modifications soldiers are using in the field. Loop shaped handles are covered in application Ser. No. 09/293,403 while other shapes, including tabs, are the subject matter of this application. As used in this Application, the terms "looped" and "tab", or "non-looped", refers to the number of terminal ends of the handle that are connected to the sleeve. A "looped" handle has all terminal ends connected to the sleeve while a "tab" or "non-looped" handle has at least one terminal end that is not attached to the sleeve. The non-looped handle extends from the top middle of the sleeve and may be formed into any shape, though the handle should maintain enough rigidity and extend from the sleeve a sufficient length to accomplish the many objects of the invention enumerated below. Two triangular sections on each of the elongated sides of the sleeve and two trapezoidal sections extending around the shorter sides are recessed with respect to the rest of the sleeve. These recessed areas, being thinner than the rest of the sleeve, provide the elasticity needed to stretch the sleeve over an ammunition magazine. These sections and the handle are roughened so as to provide more friction for gripping the attachment. When the handle is pulled, the attachment's design causes the sleeve to constrict around the magazine at the thicker areas of the sleeve, thus enabling the user to pull the magazine out of an ammunition pouch without the sleeve slipping off the magazine. In an alternative embodiment, the top of the handle may be molded into a shape which would further aid in gripping the handle, such as a ball, ridge, or crossbeam design.

This design has numerous advantages over the prior art. First, the magazine grip is cleaner and easier to remove than the methods currently used in the field. Second, the sleeve increases friction between the fingers and the ammunition magazine, which allows for the easier conventional extraction of the magazine rather than prohibiting this means of extraction. Third, the standard means of ejection causes the butt end of the magazine to impact the ground. The molded handle acts as a shock absorber for the magazine when it is ejected from the rifle and reduces impact damage to the magazine. Fourth, the magazine grip is slightly wider than the compartments in a standard ammunition pouch. As such, the magazine grip raises the magazines off of the bottom of the pouch and lessens incidents of jamming of the first cartridge in the magazine. Raising the magazine also facilitates drying the ammunition in the event the pouch gets wet. Fifth, the magazine grip abuts against the attachments on other magazines in the pouch and against the lid of the pouch. This abutment effectively anchors one magazine against the magazines next to it and to and the pouch and reduces noise caused both by the rattling of magazines against each other and up and down against the pouch when the user is moving. Sixth, the present invention, with a tab style handle, is better adapted for use by soldiers with thicker fingers, especially when wearing gloves.

The more important features of the invention have thus been outlined in order that the more detailed description that follows may be better understood and in order that the present contribution to the art may better be appreciated. Additional features of the invention will be described hereinafter and will form the subject matter of the claims that follow.

The primary object of the present invention is to provide a magazine grip attachment for use on ammunition magazines to aid in their extraction from ammunition pouches.

It is another object of the invention to provide an attachment that will accommodate users by being adaptable to individual styles of extraction, locations of the pouch on the user, and location of the rifle's ammunition chamber.

It is an additional object of the invention to provide an attachment that increases friction on the butt end of the magazine to aid in the conventional extraction of the magazine from the ammunition pouch, instead of prohibiting this means of extraction.

It is yet another object of the invention to provide an attachment that is easily removed for replacement and cleaning and, when removed from the magazine, will not leave any residues that would increase cleaning time.

It is a further object of the invention to provide an attachment that will absorb some of the shock of impact when an ammunition magazine is ejected from a rifle.

It is a still further object of the invention to provide an attachment that will raise the magazines relative to the ammunition pouch, keeping ammunition from jamming and allowing water to drain from the magazine in the event to pouch gets wet.

It is an even further object of the invention to provide an attachment that will deaden noise caused by rattling of ammunition magazines in the ammunition pouch.

It is yet another object of the invention to provide an attachment, the manufacture of which is readily adaptable to create such attachments for different sizes and calibers of hand held weapons.

It is yet another object of the invention to provide an attachment with a handle which is more suited towards use with gloved hands or thicker fingers.

Lastly, it is an object of the invention to provide a simple attachment that is easy and economical to manufacture so as to keep cost to the consuming public reasonable.

Other objects of this invention will appear from the following description and appended claims, reference being made to the accompanying drawings forming a part of this specification wherein like reference characters designate corresponding parts in the several views.

Before explaining at least one embodiment of the invention in detail, it is to be understood that the invention is not limited in its application to the details of construction and the arrangements of the components set forth in the following description or illustrated in the drawings. The invention is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

BRIEF DESCRIPTION OF THE DRAWINGS

FIG. 5 is a longitudinal section of the invention.

FIG. 6 is a cross section of the invention.

FIG. 7*a* is a sectional view of the invention, detailing the invention's braking structure.

FIG. 7*b* is a sectional view of the invention showing the braking structure when the invention is placed on the butt end of an ammunition magazine.

FIG. 7*c* is a close-up sectional view of the invention, detailing the invention's braking structure.

FIG. 7*d* is a close-up sectional view of the invention showing the braking structure when the invention is placed on the butt end of an ammunition magazine.

DETAILED DESCRIPTION OF THE PREFERRED EMBODIMENT

Figure 1:
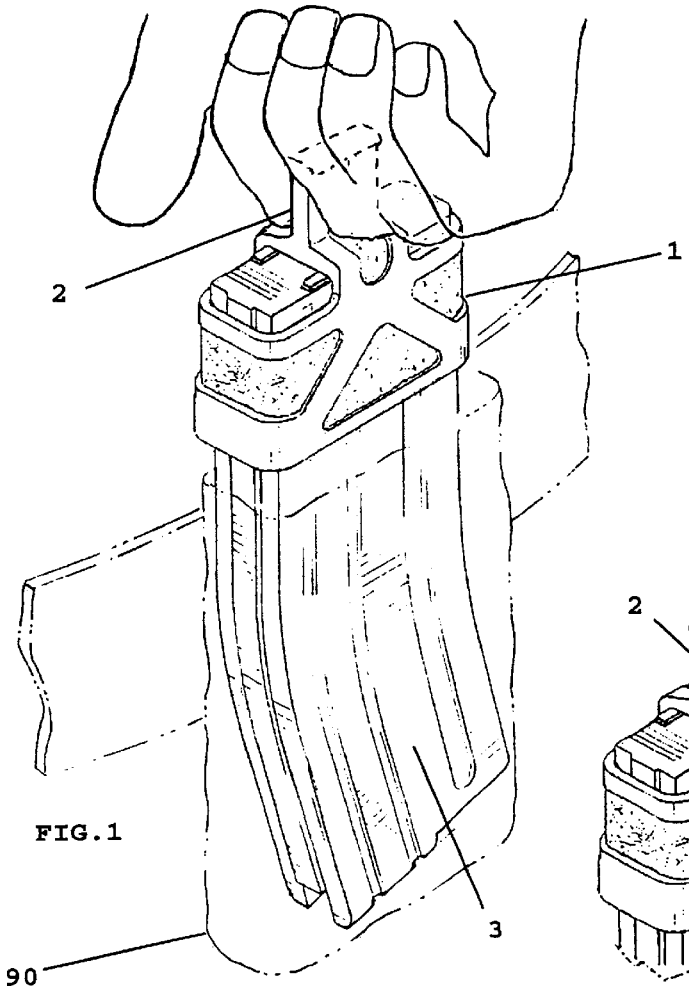
FIG. 1 is a perspective view of the invention secured on an ammunition magazine in a one-magazine ammunition pouch.
Figure 2:
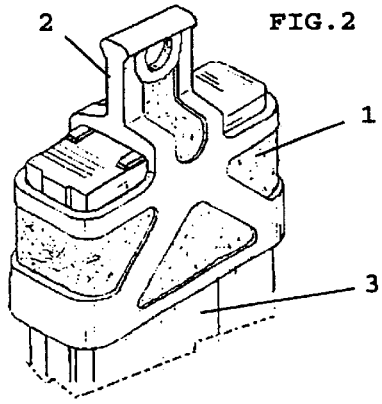
FIG. 2 is a perspective view of the invention secured on the floor end of an ammunition magazine.

With reference now to the drawings, the preferred embodiment of the new and improved magazine grip for ammunition magazines embodying the principles and concepts of the present invention will be described. Specifically, it will be noted in the figures, especially FIG. 1, that the invention relates to a sleeve of material snugly fitted over an ammunition magazine with a handle projecting from the top side of the sleeve. The invention is composed of a resilient material, such as silicone rubber or thermoplastic, and has two main features, a sleeve 1, with a width of approximately 1.5–1.75 inches though this may be varied depending on the type of magazine, designed to fit over the butt end of an ammunition magazine 3, said magazine being stored in an ammunition pouch 90, and a handle 2, as shown in FIGS. 1 and 2. When composed of a moldable material, sleeve 1 is molded in a rectangular shape, corresponding to the dimensions of an ammunition magazine 3 and can also be said to have two parts, the upper 4 and lower 6 sections. As shown in FIG. 5, upper section 4 is molded with an inner circumference, $D_1$, slightly smaller than the circumference of an ammunition magazine, thus forcing it to stretch in order to fit over a magazine. Likewise, lower section 6 is also molded with an inner circumference, $D_2$, slightly smaller than that of an ammunition magazine, but also slightly larger than $D_1$. A small breaking edge 8 is formed at the juncture of the two sections, shown in still greater detail in FIGS. 7*a* and 7*c*. When the magazine 3 is inserted in the invention, the upper section 4 is more taut than the lower section 6 and breaking edge 8 is stretched flush with the magazine's wall, as shown in FIGS. 7*b* and 7*d*.

Referring again to FIG. 2, handle 2 extends from the top center of the sleeve's longitudinal sides 10. The handle 2 is approximately the same height as the width of the sleeve 1, though this may vary. The handle may be of any shape: a cylinder, a polygonal tab, an inverted wedge or a more complex shape. The best mode handle would be a polygonal tab or wedge, since this shape variation is currently used in the field and would be familiar to soldiers and other users. A grip aid 20, such as the ridge shown in FIG. 2, may be added to the top of the handle to aid in extraction from the pouch when worn in some positions, but may interfere with use in other instances. As such, best mode is best left to the individual preferences of the user. Also provided should be a reinforced hole 24 to allow the user to hook the magazines on a carabineer after the ammunition is spent and the user removes the magazine from the weapon.

Figure 3:
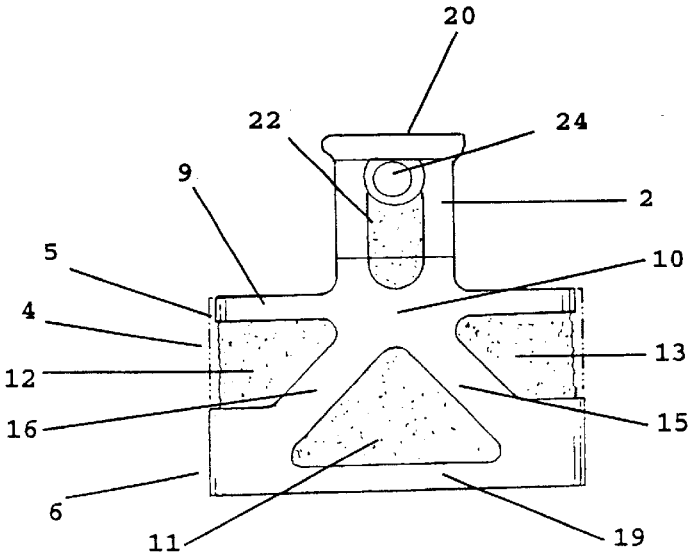
FIG. 3 is a front plan view of the invention.

Referring to FIGS. 3, 5, 6, centrally located on and extending along the handle are two of six recessed areas 22 and 22*a*. The number and shape recessed areas 22 and 22*a* would be determined by the shape of handle 2. The remaining four recessed areas 11, 12, 13, 14, two of which, 12, 13, are in a triangular shape and two of which, 11, 14, are in a trapezoidal shape, define four diagonal force distribution beams 15, 16 (two shown in FIG. 3). The recessed areas 11, 12, 13, 14, 22 and 22*a* are all roughened to increase friction between the fingers and the invention. Since these areas are recessed, the friction between the magazine grip and the pouch and other magazine grips is not increased by these areas' increased roughness. Instead, all areas of contact are smooth in order to facilitate extraction. The recessed areas 11, 12, 13, 14 also provide the elasticity necessary for the invention to be stretched over the butt of an ammunition magazine 3.

As shown in FIG. 7*a*, the thickness of the walls of the sleeve 1 vary, depending on the location of the recessed areas and whether the thickness is measured at the top or bottom of the sleeve. The walls at the top border 9 of the sleeve 1 have a thickness of $D_3$, at the recessed areas the thickness is $D_4$, and the thickness is $D_5$ at the bottom border 19 of the sleeve 1. The relationship between these three distances is as follows: $D_5>D_3>D_4$. It should be noted that $D_4$, the thickness of the recessed areas in the sleeve, may be 0. Totally eliminating the material within the recessed areas does not inhibit performance of the magazine extraction grip and may facilitate use with particular types of ammunition magazines, namely the HKG36 or SIG550 which have male and female connectors on the butt end of the magazines so that magazines may be joined together.

Figure 4:
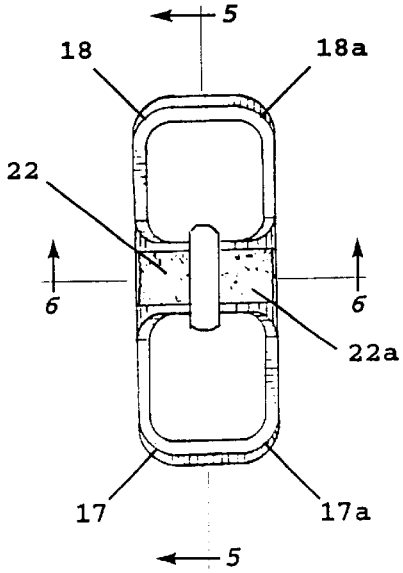
FIG. 4 is a top plan view of the invention.
Figure 8:
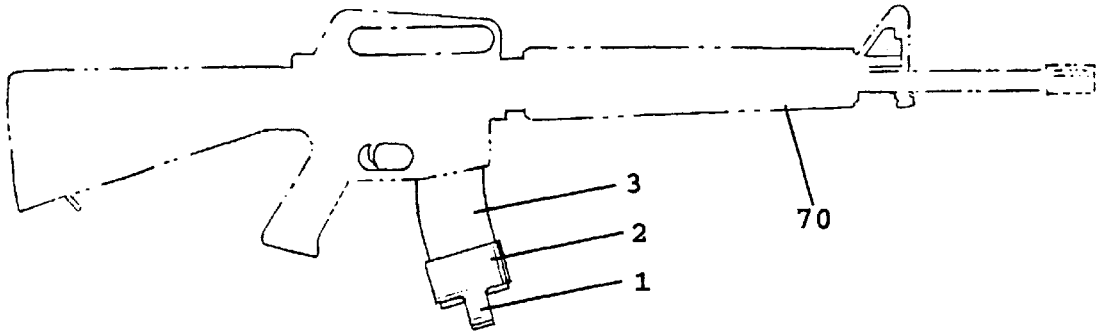
FIG. 8 is a side elevation of an M16 A-2 automatic rifle with the invention positioned on the rifle's ammunition magazine.

The beams 15, 16 (and two others, 15*a* and 16*a*, not shown but otherwise identical to 15 and 16) extend from the ends of the handle 2 at the top center of the sleeve 10 to the bottom corners of the sleeve 17, 17*a*, 18, 18*a*, which are shown in FIG. 4. When the handle 2 is pulled, the force of the pull is directed down the four distribution beams 15, 15*a*, 16, 16*a* towards the bottom corners of the sleeve 17, 17*a*, 18, 18*a*. This distribution causes the lower section 6 of the sleeve 1 to constrict along its lower border 19 and attempt to fold up over the upper section 4. However, the greater tension in the upper section 4 combined with the breaking edge 8 causes the upper section 4 to bow, which is shown in an exaggerated form 5 in FIG. 3, preventing the folding action and forcing the lower section 6 to grip the magazine as the user pulls the magazine 3 out of the ammunition pouch 80. The bottom corners 17, 17*a*, 18, 18*a* are molded with a greater thickness than the remaining areas of the sleeve 1 so as to better withstand the force placed on them during this operation. Once extracted from the pouch, the magazine 3 is then inverted and placed in the rifle 70, as seen in FIG. 8.

Figure 9:
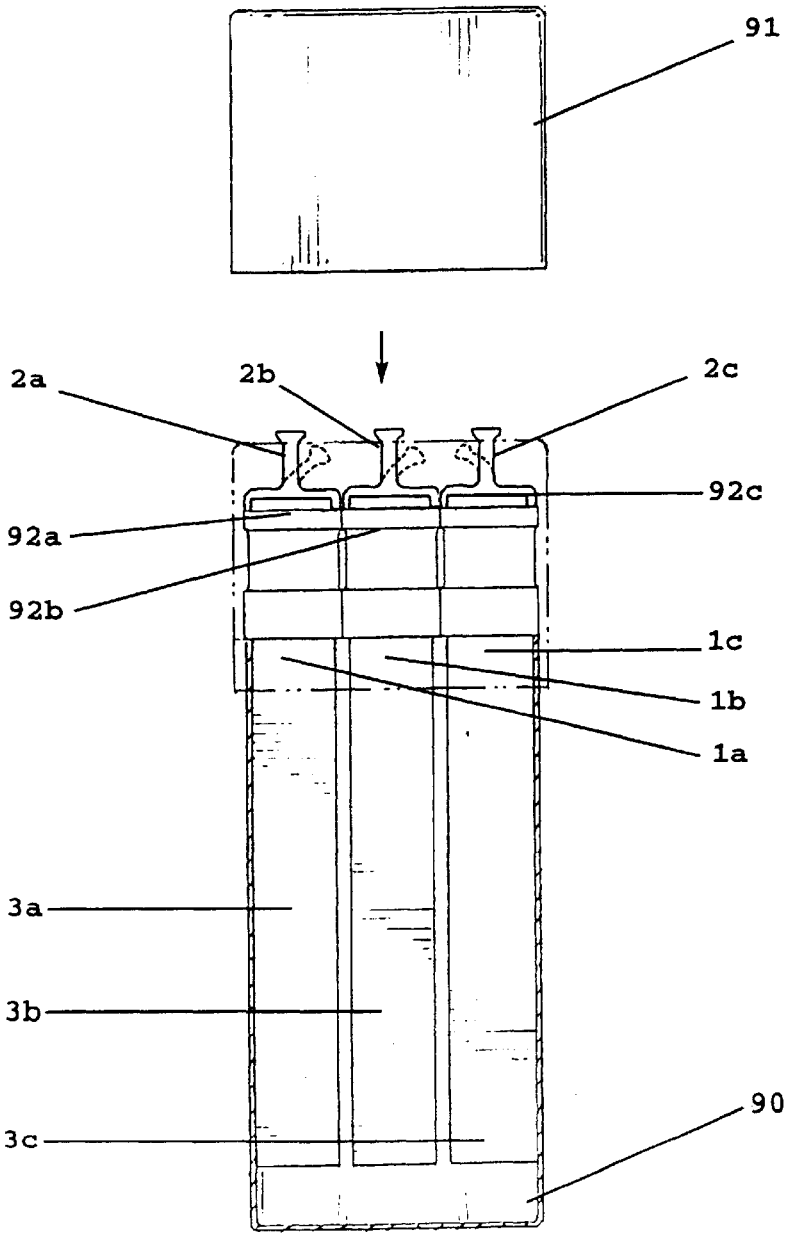
FIG. 9 is a cross section showing the combination of a three-magazine pouch with the invention and the folding of the invention's handles when the pouch is sealed.

Referring next to FIG. 9, three magazines 3*a*, 3*b*, 3*c* are inserted in a magazine pouch 90. The handles of three magazine grips 2*a*, 2*b*, 2*c* fold down into a stowed position, shown as 92*a*, 92*b*, 92*c*, over each other, when the pouch lid 91 is closed over the magazines. The sleeves 1*a*, 1*b*, 1*c* also abut each other and the sides of the pouch lid 91. As a result of the folding and the abutment, the magazines are effectively anchored against the pouch and each other, reducing both horizontal and vertical movements, and the noise, of the magazines while the user is in motion.

Although the present invention has been described with reference to preferred embodiments, numerous modifications and variations can be made and still the result will come within the scope of the invention. No limitation with respect to the specific embodiments disclosed herein is intended or should be inferred.

I claim:

1. For an ammunition magazine having a feed end configured to interface with a firearm and a floor end opposite thereof, a magazine grip comprising:

a resilient cylindrical sleeve, not made of adhesive material, shaped and sized to receive and tightly hold a floor end of a given ammunition magazine with an interior circumference smaller than an exterior circumference of the given ammunition magazine; and a handle attached to the cylindrical sleeve;

wherein the sleeve has both an interior and exterior circumference and has both bottom and top ends, said top end being the end attached to the handle and each of said ends having a border, the magazine grip to be positioned on the given magazine in a manner so as to not cover the feed end of the magazine.

2. The magazine grip of claim 1, wherein the interior circumference of the top end of the cylindrical sleeve is smaller than the exterior circumference of the given magazine and the bottom end of the cylindrical sleeve has a larger interior circumference than the interior circumference of the top end.

3. The magazine grip of claim 2, wherein the handle is non-looped and the shape of the handle is selected from the group of shapes consisting of: a polygonal tab, a wedge, an ellipsoidal tab, a shape having any combination of rounded and straight edges, a cylinder, and a rectangular solid.

4. The magazine grip of claim 2, wherein the grip is made from a material selected from the group consisting of plastic, thermoplastic, rubber, silicone rubber, and fabric.

5. The magazine grip of claim 4,wherein the handle is non-looped and the shape of the handle is selected from the group of shapes consisting of: a polygonal tab, a wedge, an ellipsoidal tab, a shape having any combination of rounded and straight edges, a cylinder and a rectangular solid.

6. The magazine grip of claim 4, wherein a plurality of hollows are fashioned in the sleeve and handle, each hollow defining an interior region.

7. The magazine grip of claim 6, wherein the handle is non-looped and the shape of the handle is selected from the group of shapes consisting of: a polygonal tab, a wedge, an ellipsoidal tab, shape having any combination of rounded and straight edges, a cylinder and a rectangular solid.

8. The magazine grip of claim 6, wherein the interior regions of the hollows are roughened to increase friction.

9. The magazine grip of claim 8, wherein the handle is non-looped and the shape of the handle is selected from the group of shapes consisting of: a polygonal tab, a wedge, an ellipsoidal tab, a shape having any combination of rounded and straight edges, a cylinder, and a rectangular solid.

10. The magazine grip of claim 8, wherein the bottom border of the sleeve is molded with greater thickness respective to the remainder of said magazine grip.

11. The magazine grip of claim 10, wherein the handle is non-looped and the handle is shaped according to the following set of shapes: a polygonal tab, a wedge, an ellipsoidal tab, a shape having any combination of rounded and straight edges, a cylinder, and a rectangular solid.

12. The magazine grip of claim 10, wherein the cylindrical sleeve is fashioned in a rectangular shape, having eight corners, in conformity with an ammunition magazine.

13. The magazine grip of claim 12, wherein the handle is non-looped and the shape of the handle is selected from the group of shapes consisting of: a polygonal tab, a wedge, an ellipsoidal tab, a shape having any combination of rounded and straight edges, a cylinder, and a rectangular solid.

14. The magazine grip of claim 12, wherein the sleeve height measures 1.0 to 1.5 inches and the handle height measures 1.0 to 1.5 inches.

15. The magazine grip of claim 14, wherein the handle is non-looped and the shape of the handle is selected from the group of shapes consisting of a polygonal tab, a wedge, an ellipsoidal tab, a shape having any combination of rounded and straight edges, a cylinder, and a rectangular solid.

16. The magazine grip of claim 14, wherein a hole, suitable for attachment purposes, is fashioned in the handle.

17. The magazine grip of claim 16, wherein the handle is non-looped and the shape of the handle is selected from the group of shapes consisting of: a polygonal tab, a wedge, an ellipsoidal tab, a shape having any combination of rounded and straight edges, a cylinder, and a rectangular solid.

18. The magazine grip of claim 2, wherein a plurality of hollows are fashioned in the sleeve and handle, each hollow defining an interior region.

19. The magazine grip of claim 18, wherein the handle is non-looped and the shape of the handle is selected from the group of shapes consisting of: a polygonal tab, a wedge, an ellipsoidal tab, a shape having any combination of rounded and straight edges, a cylinder, and a rectangular solid.

20. The magazine grip of claim 18, wherein the interior regions of the hollows are roughened to increase friction.

21. The magazine grip of claim 20, wherein the handle is non-looped and the shape of the handle is selected from the group of shapes consisting of: a polygonal tab, a wedge, an ellipsoidal tab, a shape having any combination of rounded and straight edges, a cylinder, and a rectangular solid.

22. The magazine grip of claim 20, wherein the bottom border of the sleeve is molded with greater thickness respective to the remainder of said magazine grip.

23. The magazine grip of claim 22, wherein the handle is non-looped and the shape of the handle is selected from the group of shapes consisting of: a polygonal tab, a wedge, an ellipsoidal tab, a shape having any combination of rounded and straight edges, a cylinder, and a rectangular solid.

24. The magazine grip of claim 22, wherein the cylindrical sleeve is fashioned in a rectangular shape, having eight corners, in conformity with an ammunition magazine.

25. The magazine grip of claim 24, wherein the handle is non-looped and the shape of the handle is selected from the group of shapes consisting of: a polygonal tab, a wedge, an ellipsoidal tab, a shape having any combination of rounded and straight edges, a cylinder, and a rectangular solid.

26. The magazine grip of claim 24, wherein the sleeve height measures 1.0 to 1.5 inches and the handle height measures 1.0 to 1.5 inches.

27. The magazine grip of claim 26, wherein the handle is non-looped and the shape of the handle is selected from the group of shapes consisting of: a polygonal tab, a wedge, an ellipsoidal tab, a shape having any combination of rounded and straight edges, a cylinder, and a rectangular solid.

28. The magazine grip of claim 26, wherein a hole, suitable for attachment purposes, is fashioned in the handle.

29. The magazine grip of claim 28, wherein the handle is non-looped and the shape of the handle is selected from the group of shapes consisting of: a polygonal tab, a wedge, an ellipsoidal tab, a shape having any combination of rounded and straight edges, a cylinder, and a rectangular solid.

30. For an ammunition magazine having a feed end configured to interface with a firearm and a floor end opposite thereof, a magazine grip comprising:

a resilient cylindrical sleeve, not made of adhesive material, shaped and sized to receive and tightly hold a floor end of a given ammunition magazine with an interior circumference smaller than an exterior circumference of the given ammunition magazine;

a handle attached to the cylindrical sleeve; and a gripping aid attached to the handle;

wherein the sleeve has both an interior and exterior circumference and has both bottom and top ends, said top end being the end attached to the handle and each of said ends having a border, the magazine grip to be positioned on the given magazine in a manner so as to not cover the feed end of the magazine.

31. The magazine grip of claim 30, wherein the interior circumference of the top end of the cylindrical sleeve is smaller than the exterior circumference of the given magazine and the bottom end has a larger interior circumference than the interior circumference of the top end.

32. The magazine grip of claim 31, wherein the handle is non-looped and the shape of the handle is selected from the group of shapes consisting of: a polygonal tab, a wedge, an ellipsoidal tab, a shape having any combination of rounded and straight edges, a cylinder, and a rectangular solid.

33. The magazine grip of claim 31, wherein the grip is made from a material selected from the group consisting of plastic, thermoplastic, rubber, silicone rubber, and fabric.

34. The magazine grip of claim 33, wherein the handle is non-looped and the shape of the handle is selected from the group of shapes consisting of: a polygonal tab, a wedge, an ellipsoidal tab, a shape having any combination of rounded and straight edges, a cylinder, and a rectangular solid.

35. The magazine grip of claim 33, wherein a plurality of hollows are fashioned in the sleeve and handle, each hollow defining an interior region.

36. The magazine grip of claim 35, wherein the handle is non-looped and the shape of the handle is selected from the group of shapes consisting of: a polygonal tab, a wedge, an ellipsoidal tab, a shape having any combination of rounded and straight edges, a cylinder, and a rectangular solid.

37. The magazine grip of claim 35, wherein the interior regions of the hollows are roughened to increase friction.

38. The magazine grip of claim 37, wherein the handle is non-looped and the shape of the handle is selected from the group of shapes consisting of: a polygonal tab, a wedge, an ellipsoidal tab, a shape having any combination of rounded and straight edges, a cylinder, and a rectangular solid.

39. The magazine grip of claim 37, wherein the bottom border of the sleeve is molded with greater thickness respective to the remainder of said magazine grip.

40. The magazine grip of claim 39, wherein the handle is non-looped and the shape of the handle is selected from the group of shapes consisting of: a polygonal tab, a wedge, an ellipsoidal tab, a shape having any combination of rounded and straight edges, a cylinder, and a rectangular solid.

41. The magazine grip of claim 39, wherein the cylindrical sleeve is fashioned in a rectangular shape, having eight corners, in conformity with an ammunition magazine.

42. The magazine grip of claim 41, wherein the handle is non-looped and the shape of the handle is selected from the group of shapes consisting of: a polygonal tab, a wedge, an ellipsoidal tab, a shape having any combination of rounded and straight edges, a cylinder, and a rectangular solid.

43. The magazine grip of claim 41, wherein the sleeve height measures 1.0 to 1.5 inches and the handle height measures 1.0 to 1.5 inches.

44. The magazine grip of claim 43, wherein the handle is non-looped and the shape of the handle is selected from the group of shapes consisting of: a polygonal tab, a wedge, an ellipsoidal tab, a shape having any combination of rounded and straight edges, a cylinder, and a rectangular solid.

45. The magazine grip of claim 43, wherein a hole, suitable for attachment purposes, is fashioned in the handle.

46. The magazine grip of claim 45, wherein the handle is non-looped and the shape of the handle is selected from the group of shapes consisting of: a polygonal tab, a wedge, an ellipsoidal tab, a shape having any combination of rounded and straight edges, a cylinder, and a rectangular solid.

47. The magazine grip of claim 31, wherein a plurality of hollows are fashioned in the sleeve and handle, each hollow defining an interior region.

48. The magazine grip of claim 47, wherein the handle is non-looped and the shape of the handle is selected from the group of shapes consisting of: a polygonal tab, a wedge, an ellipsoidal tab, a shape having any combination of rounded and straight edges, a cylinder, and a rectangular solid.

49. The magazine grip of claim 47, wherein the interior regions of the hollows are roughened to increase friction.

50. The magazine grip of claim 49, wherein the handle is non-looped and the shape of the handle is selected from the group of shapes consisting of: a polygonal tab, a wedge, an ellipsoidal tab, a shape having any combination of rounded and straight edges, a cylinder, and a rectangular solid.

51. The magazine grip of claim 49, wherein the bottom border of the sleeve is molded with greater thickness respective to the remainder of said magazine grip.

52. The magazine grip of claim 51, wherein the handle is non-looped and the shape of the handle is selected from the group of shapes consisting of: a polygonal tab, a wedge, an ellipsoidal tab, a shape having any combination of rounded and straight edges, a cylinder, and a rectangular solid.

53. The magazine grip of claim 51, wherein the cylindrical sleeve is fashioned in a rectangular shape, having eight corners, in conformity with an ammunition magazine.

54. The magazine grip of claim 53, wherein the handle is non-looped and the shape of the handle is selected from the group of shapes consisting of: a polygonal tab, a wedge, an ellipsoidal tab, a shape having any combination of rounded and straight edges, a cylinder, and a rectangular solid.

55. The magazine grip of claim 53, wherein the sleeve height measures 1.0 to 1.5 inches and the handle height measures 1.0 to 1.5 inches.

56. The magazine grip of claim 55, wherein the handle is non-looped and the shape of the handle is selected from the group of shapes consisting of: a polygonal tab, a wedge, an ellipsoidal tab, a shape having any combination of rounded and straight edges, a cylinder, and a rectangular solid.

57. The magazine grip of claim 55, wherein a hole, suitable for attachment purposes, is fashioned in the handle.

58. The magazine grip of claim 57, wherein the handle is non-looped and the shape of the handle is selected from the group of shapes consisting of: a polygonal tab, a wedge, an ellipsoidal tab, a shape having any combination of rounded and straight edges, a cylinder, and a rectangular solid.

59. The improvement of least one of the magazine grips according to either of claims 1–58 in combination with a magazine pouch suited to receive a plurality of magazines, said pouch having a top flap, the improvement comprising:

a. at least one magazine grip mounted on a butt end of at least one member of a set of ammunition magazines placed within the magazine pouch, wherein said magazines have feed and butt ends and any said magazines are inserted feed end down in said pouch; and b. the top flap of said pouch, wherein the any handles of any magazine grips act as a buffer and the sides of the sleeves abut each other and the walls of the flap, wherein motion of the magazines relative to the pouch and each other, and therefore noise, is reduced.

* * * * *